US008070416B2

(12) United States Patent
Gottemoller et al.

(10) Patent No.: US 8,070,416 B2
(45) Date of Patent: Dec. 6, 2011

(54) FLOW REGULATION MECHANISM FOR TURBOCHARGER COMPRESSOR

(75) Inventors: Paul Gottemoller, Palos Park, IL (US); Terry G. Wood, Countryside, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 434 days.

(21) Appl. No.: 12/056,983

(22) Filed: Mar. 27, 2008

(65) Prior Publication Data

US 2010/0260595 A1 Oct. 14, 2010

(51) Int. Cl.
*F04D 23/00* (2006.01)

(52) U.S. Cl. ..... 415/53.3; 415/56.4; 415/57.1; 415/58.3; 415/58.4; 415/58.6; 415/149.1; 415/127; 415/206; 415/224.5

(58) Field of Classification Search ..... 415/53.3, 415/56.4, 57.1, 58.2, 58.3, 58.4, 58.6, 127, 415/148, 149.1, 211.1, 211.2, 212.1, 206, 415/224.5

See application file for complete search history.

(56) References Cited

U.S. PATENT DOCUMENTS

| | | | | |
|---|---|---|---|---|
| 2,336,010 | A * | 12/1943 | Gregory et al. | 415/159 |
| 2,874,642 | A * | 2/1959 | Forrest | 415/52.1 |
| 2,927,536 | A * | 3/1960 | Rhoades | 415/48 |
| 3,478,955 | A * | 11/1969 | Kunderman | 417/507 |
| 3,814,538 | A * | 6/1974 | Sjoqvist | 415/220 |
| 4,579,509 | A * | 4/1986 | Jacobi | 415/199.1 |
| 4,752,183 | A * | 6/1988 | Sakurai | 415/12 |
| 5,758,500 | A * | 6/1998 | Sumser et al. | 60/602 |
| 6,139,262 | A * | 10/2000 | Ravidranath | 415/150 |
| 6,715,288 | B1 * | 4/2004 | Engels et al. | 60/602 |

* cited by examiner

*Primary Examiner* — Igor Kershteyn

(74) *Attorney, Agent, or Firm* — Jack D. Nimz; Jeffrey P. Calfa

(57) ABSTRACT

A turbocharger (10) for an internal combustion engine includes a compressor (12) having an impellor (16) disposed in a compressor chamber (18). The compressor chamber (18) receives fluid flow. A flow regulation mechanism (30) is disposed in the compressor (12) and includes a diffuser cover (32) and a recirculation gate (36). The diffuser cover (32) is moveably disposed in a diffuser passage (34) from a first position permitting fluid flow through the diffuser passage to a second position at least partially impeding the fluid flow. The recirculation gate (36) is moveably disposed in the compressor chamber (18) from a first position closing a recirculation groove (48) to a second position opening the recirculation groove to fluid communication with the compressor chamber.

20 Claims, 3 Drawing Sheets

FLOW REGULATION MECHANISM FOR TURBOCHARGER COMPRESSOR

FIELD OF THE INVENTION

This invention generally relates to compressors for turbochargers used in internal combustion engines. More particularly, this invention relates to turbocharger compressors having a flow regulation mechanism.

BACKGROUND OF THE INVENTION

Internal combustion engines convert chemical energy from a fuel into mechanical energy. Most internal combustion engines inject an air-fuel mixture into one or more cylinders. The fuel ignites to generate rapidly expanding gases that actuate a piston in the cylinder. The fuel can be ignited by compression such as in a diesel engine or through some type of spark such as the spark plug in a gasoline engine. The piston usually is connected to a crankshaft or similar device for converting the reciprocating motion of the piston into rotational motion.

Many internal combustion engines have a turbocharger to pressurize or boost the amount of air flowing into the cylinders. The additional air in a cylinder permits the combustion of additional fuel in the cylinder. The combustion of additional fuel increases the power generated by the engine.

Turbochargers typically operate in response to the engine operation. Generally, a turbocharger spins faster when the engine speed is increased and spins slower when the engine speed decreases. If the turbocharger operates too fast, the turbocharger output can reduce engine performance and can damage the turbocharger and other engine components. If the turbocharger operates too slow, the engine can hesitate, loose power, or otherwise operate inefficiently. Thus, there is an operating range for optimal turbocharger performance.

Most turbocharged diesel engines have an air supply system that, as engine speed and load is increased, the turbocharger rotations per minute (RPM) increases, causing the air flow and the pressure to the engine to increase. This results in changes to the in-cylinder trapped air density, and turbulence and swirl, which makes optimization of the combustion system difficult. The turbocharger efficiency also can be affected by changes in atmospheric pressure, ambient temperature, and engine speed.

In an ideal, optimized combustion system using a turbocharger, a constant flow velocity and a constant in-cylinder air density would be produced independent of engine speed and load, and therefore the fuel injection system could produce the same injection profile independent of engine speed and load. With these features, the combustion system could be optimized independent of engine speed and load. Thus, supplying air at a constant pressure independent of engine speed, in a manner that is practical, low-cost and easily implemented on a traditional turbocharger, is needed.

SUMMARY OF THE INVENTION

A turbocharger for an internal combustion engine includes a compressor having an impellor disposed in a compressor chamber. The compressor chamber receives fluid flow. A flow regulation mechanism is disposed in the compressor and includes a diffuser cover and a recirculation gate. The diffuser cover is moveably disposed in a diffuser passage from a first position permitting fluid flow through the diffuser passage to a second position at least partially impeding the fluid flow. The recirculation gate is moveably disposed in the compressor chamber from a first position closing a recirculation groove to a second position opening a recirculation groove to fluid communication with the compressor chamber. The diffuser cover and the recirculation gate are moved generally simultaneously from the respective first positions to the respective second positions to at least partially impede fluid flow and the recirculation gate is opened to allow fluid flow through the recirculation groove.

DESCRIPTION OF A PREFERRED EMBODIMENT

Figure 1:
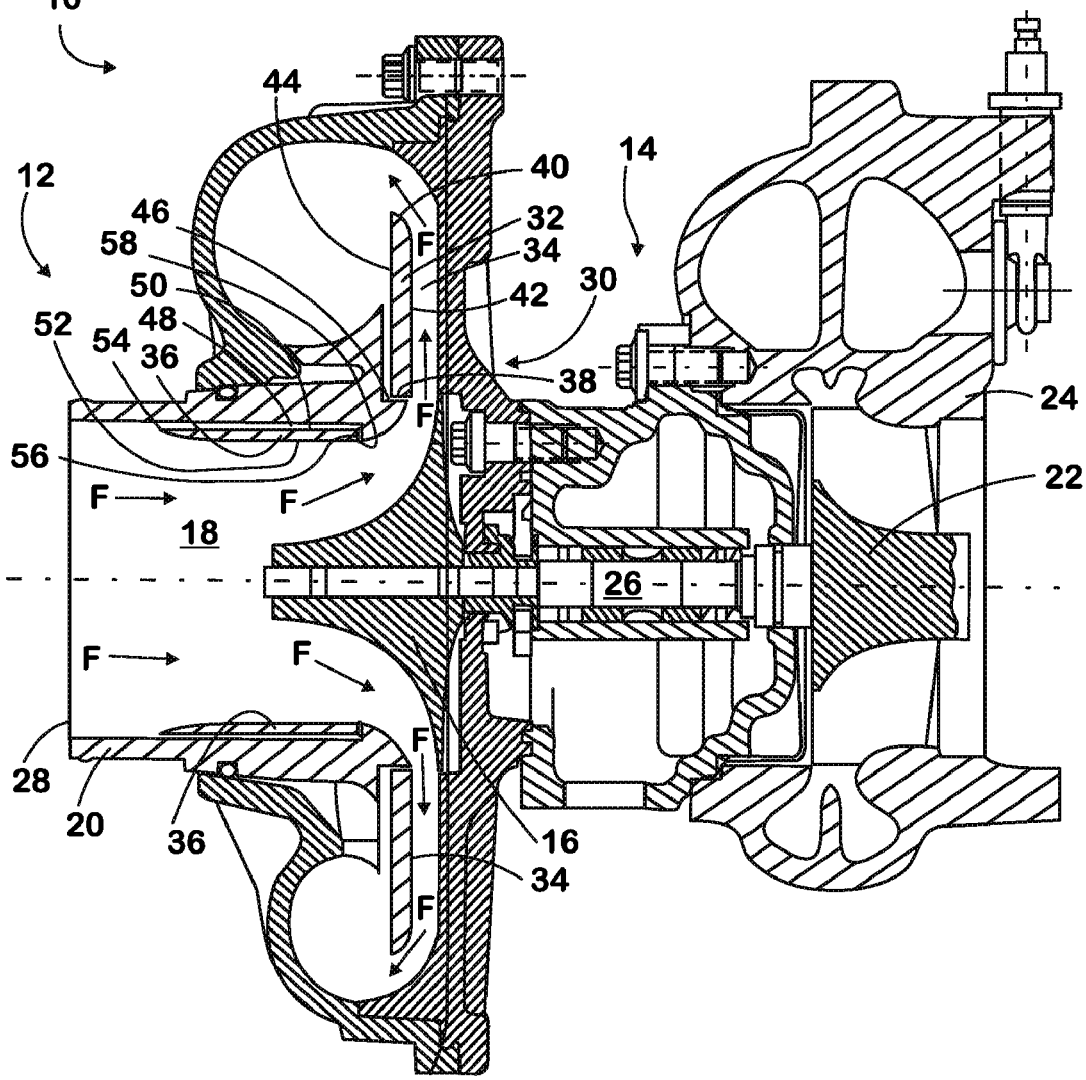
FIG. 1 is a section view of a turbocharger with a compressor having a flow regulation mechanism in a first position.
Figure 2:
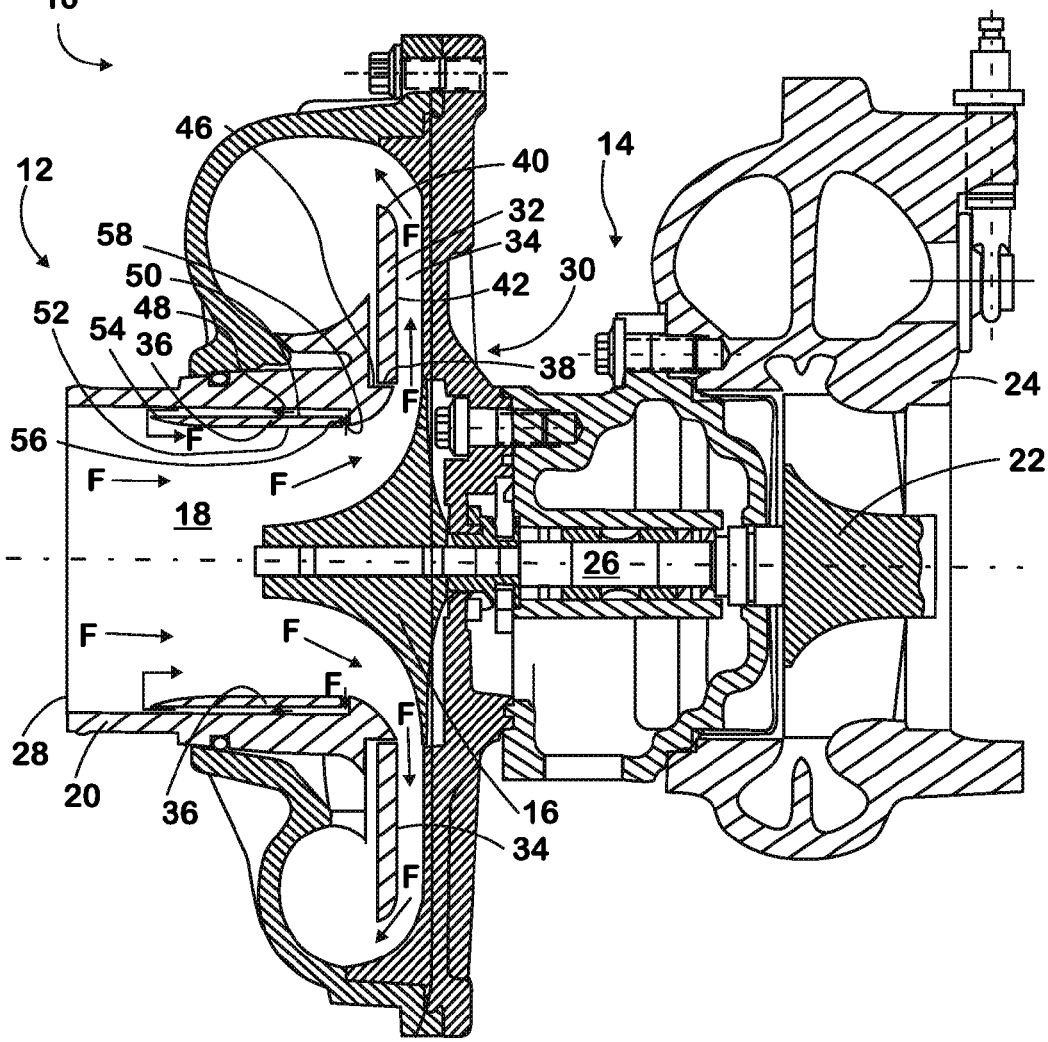
FIG. 2 is a section view of the turbocharger with the compressor of FIG. 1 having the flow regulation mechanism in a second position.

Referring to FIGS. 1 and 2, a turbocharger is indicated generally at 10 and includes a compressor 12 and a turbine 14 attached to the compressor. The compressor 12 includes a centrifugal impellor 16 positioned to spin inside a compressor chamber 18 formed by a compressor housing 20. The turbine 14 has a turbine wheel 22 positioned to spin inside of a turbine housing 24. Typically, the turbine wheel 22 is connected to the centrifugal impellor 16 through a common shaft 26, and the turbocharger 10 is mounted near the exhaust manifold of the engine (not shown).

Intake fluid "F", generally air and possibly air containing exhaust gas recirculation (EGR), is introduced at a compressor inlet 28. The fluid "F" flows from the inlet 28 into the compressor chamber 18 where the spinning centrifugal impellor 16 pressurizes the intake fluid flowing through the compressor housing 20 to cylinders in an engine (not shown).

Generally, a turbocharger 10 spins faster when the engine speed increases and spins slower when the engine speed decreases. If the turbocharger 10 operates too fast, the turbocharger output can reduce engine performance and can damage the turbocharger and other engine components. If the turbocharger 10 operates too slow, the engine can hesitate, loose power, or otherwise operate inefficiently. For this reason, a constant manifold pressure regardless of engine speed is desired for optimal-efficiency and engine performance.

To regulate the fluid "F" velocity in the compressor chamber 18 to have a substantially constant velocity incident on the impellor 16, the present turbocharger 10 includes a flow regulation mechanism 30. The flow regulation mechanism 30 includes a diffuser cover 32 disposed at a diffuser passage 34 and a recirculation gate 36 disposed in the compressor chamber 18, which operate together to regulate the fluid flow "F" through the compressor. The recirculation gate 36 is moved simultaneously with the diffuser cover 32 to keep the fluid velocity incident on the impellor 16 constant. While the present turbocharger 10 has a flow regulation mechanism 30 having two diffuser covers 32 and two recirculation gates 36, it is contemplated that any number of diffuser covers and recirculation gates can be incorporated. Further, while the present turbocharger 10 has a diffuser cover 32 having two positions and a recirculation gate having two positions, it is contemplated that any number positions can be incorporated.

The diffuser cover 32 is a generally elongate member having an upstream end 38, a downstream end 40, a foil side 42 and a rear side 44. The foil side 42 abuts the diffuser passage 34, and the rear side 44 is opposite the foil side. The downstream end 40 is generally contoured to direct the flow of fluid "F" out of the diffuser passage 34 to the engine (not shown). The diffuser cover 32 is selectively moveable from a first position fully seated on a seat 46 (FIG. 1), to a second position at least partially unseated on the seat (FIG. 2).

The recirculation gate 36 is disposed generally parallel to the compressor housing 20 and generally parallel to the fluid flow "F" in the compressor chamber 18. A recirculation groove 48 is defined between a rear side 50 of the recirculation gate and the compressor housing. A foil side 52 is opposite the rear side 50, and an upstream end 54 is generally contoured to allow fluid flow "F" along the foil side in the compressor chamber 18. A downstream end 56 defines an inlet 58 to the recirculation groove 48. The recirculation gate 36 is selectively moveable from a first position closing fluid communication through the inlet 58 of the recirculation groove 48 (FIG. 1), to a second position opening the inlet to allowing fluid communication through to the recirculation groove (FIG. 2). The diffuser cover 32 and the recirculation gate 36 move together.

When there is high engine speed, the turbocharger rotations per minute (RPM) are increased, and the fluid "F" velocity in the compressor chamber 18 incident on the impellor 16 is high. Under these conditions, the flow regulation mechanism 30 is located in the first position seen in FIG. 1. In the first position, the fluid flow "F" is unimpeded through the diffuser passage 34 by the diffuser cover 32, and the recirculation gate 36 is closed.

When the engine speed is decreased, the turbocharger RPMs are decreased, and the fluid "F" velocity in the compressor chamber 18 incident on the impellor 16 is low. Under these conditions, then the flow regulation mechanism 30 is moved to the second position in FIG. 2. In the second position, the fluid flow "F" is impeded by the diffuser cover 32, and the recirculation gate 36 is opened to allow fluid under backpressure to flow through the recirculation groove 48 formed between the recirculation gate and the compressor housing 20. After the fluid "F" exits the recirculation groove 48, the fluid travels along the foil side 52 in the compressor chamber 18. In this way, the velocity in the compressor chamber 18 is increased.

It is contemplated that the flow regulation mechanism 30 is moved between the first position and the second position automatically or manually. For example, the flow regulation mechanism 30 could be operated in response to engine manifold pressure. Alternatively, the user may initiate the movement of the flow regulation mechanism 30. In this way, a generally constant fluid "F" velocity incident on the impellor 16 can be achieved.

Figure 3:
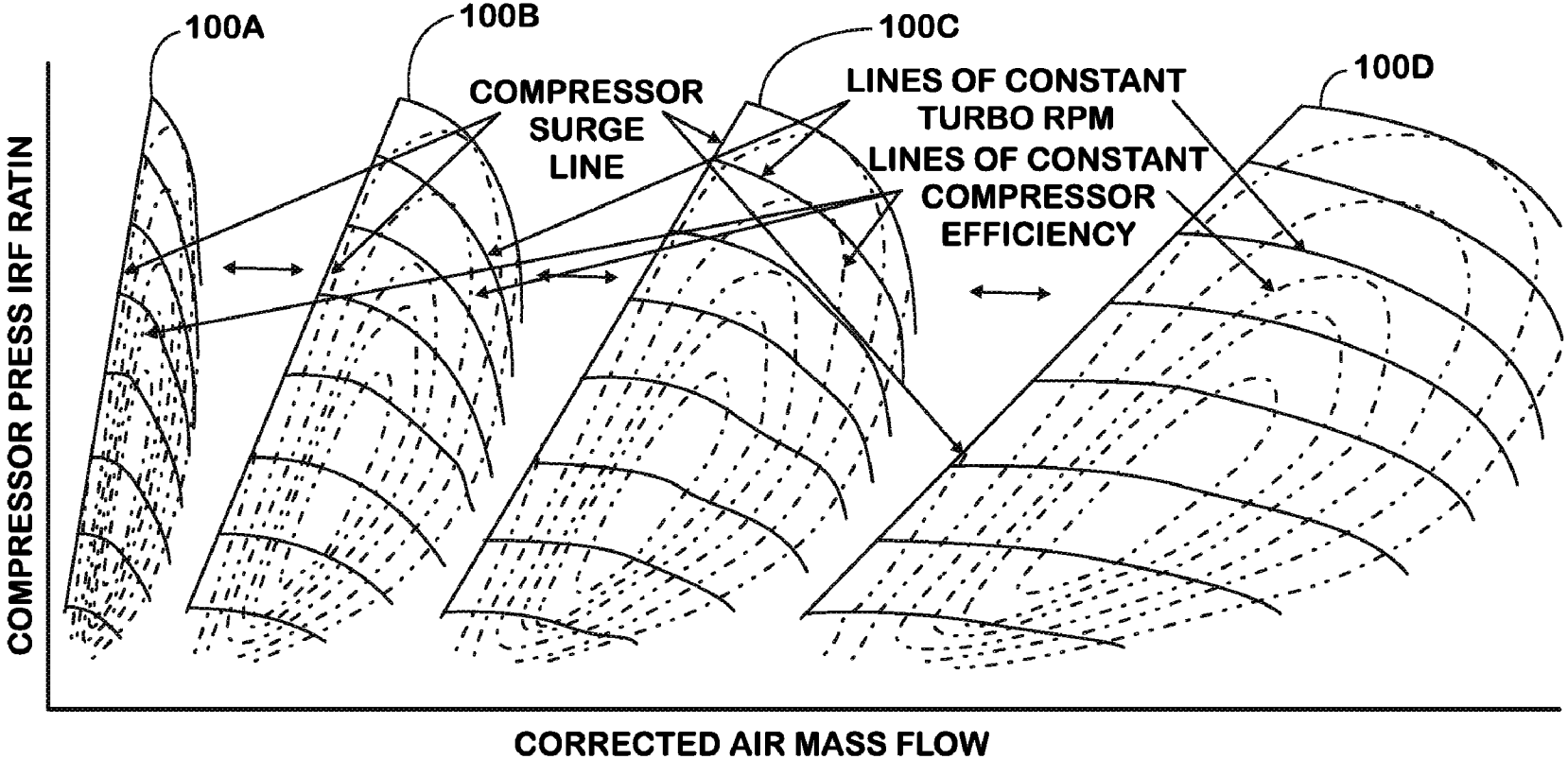
FIG. 3 is a series of compressor maps, where the left map is the compressor of FIG. 1 in the first position, and the right map is the compressor of FIG. 2 in the second position.

Referring now to FIG. 3, a series of compressor maps 100A, 100B, 100C and 100D of the compressor 12 are shown. Compressor map 100D indicates the conditions when the flow regulation mechanism 30 is in the first position, and 100A indicates the conditions when the flow regulation mechanism is in the second position. While the maps 100A-100D are depicted as discrete maps, the shift of the compressor maps is actually smooth and continuous as the flow regulation mechanism 30 moves from the first position to the second position. The maps 100A-100D indicate that while the compressor operates under lower flows, the turbocharger RPMs versus pressure relationship is constant.

Turbochargers 10 are known to have various configurations to control the output from the turbocharger. Some turbocharger configurations can have a wastegate or a valve to allow exhaust gases to bypass the turbine. It is contemplated that there may be circumstances under high speed, light load, cold engine and idle conditions where there is insufficient energy in the exhaust gas to support the operation of the turbocharger. Under these conditions, a compressor bypass valve (not shown) can be used to allow the engine to draw the intake fluid "F" around the compressor until there is enough energy in the exhaust gas to allow the compressor to meet the air flow requirements of the engine.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A turbocharger for an internal combustion engine, comprising:

a compressor having a compressor chamber for receiving fluid flow;

a flow regulation mechanism disposed in the compressor, comprising:

a diffuser cover moveably disposed in a diffuser passage to selectively permit and at least partially impede the fluid flow through the diffuser passage;

a recirculation gate moveably disposed in the compressor chamber to selectively close and open a recirculation groove from fluid communication with the compressor chamber;

wherein when there is a high fluid velocity in the compressor chamber, the fluid flow is substantially permitted through the diffuser passage by the diffuser cover and the recirculation gate is closed, and wherein when there is a low fluid velocity in the compressor chamber, the diffuser cover is moved to at least partially impede fluid flow and the recirculation gate is opened to allow fluid flow through the recirculation groove.

2. The turbocharger of claim 1 wherein the flow regulation mechanism is moved automatically to maintain a generally constant manifold pressure independent of engine speed and load.

3. The turbocharger of claim 1 wherein the flow regulation mechanism is operated manually by the user.

4. The turbocharger of claim 1 wherein the diffuser cover is a generally elongate member having an upstream end, a downstream end, a foil side and a rear side.

5. The turbocharger of claim 4 wherein the foil side defines the diffuser passage, and the downstream end is generally contoured to direct the flow of fluid out of the diffuser passage.

6. The turbocharger of claim 1 wherein the recirculation gate is disposed generally parallel to a compressor housing and defines the recirculation groove between a rear side of the recirculation gate and the compressor housing.

7. The turbocharger of claim 1 wherein the recirculation gate includes a rear side that defines the recirculation groove and a foil side opposite the rear side.

8. The turbocharger of claim 1 wherein the recirculation gate includes a generally contoured upstream end.

9. The turbocharger of claim 1 wherein the recirculation gate includes a downstream end that defines an inlet to the recirculation groove.

10. A flow regulation mechanism for a compressor of a turbocharger having a compressor chamber, the flow regulation mechanism comprising:

a diffuser cover moveably disposed in a diffuser passage to selectively permit and at least partially impede the fluid flow through the diffuser passage;

a recirculation gate moveably disposed in the compressor chamber to selectively close and open a recirculation groove from fluid communication with the compressor chamber;

wherein when there is a high fluid velocity in the compressor chamber, the fluid flow is substantially permitted through the diffuser passage by the diffuser cover and the recirculation gate is closed, and wherein when there is a low fluid velocity in the compressor chamber, the diffuser cover is moved to at least partially impede fluid flow and the recirculation gate is opened to allow fluid flow through the recirculation groove.

11. The turbocharger of claim 10 wherein the flow regulation mechanism is moved automatically to maintain a generally constant manifold pressure independent of engine speed and load.

12. The turbocharger of claim 10 wherein the flow regulation mechanism is operated manually by the user.

13. The turbocharger of claim 10 wherein the diffuser cover is a generally elongate member having an upstream end, a downstream end, a foil side and a rear side.

14. The turbocharger of claim 13 wherein the foil side defines the diffuser passage, and the downstream end is generally contoured to direct the flow of fluid out of the diffuser passage.

15. The turbocharger of claim 10 wherein the recirculation gate is disposed generally parallel to a compressor housing and defines the recirculation groove between a rear side of the recirculation gate and the compressor housing.

16. The turbocharger of claim 10 wherein the recirculation gate includes a rear side that defines the recirculation groove and a foil side opposite the rear side.

17. The turbocharger of claim 10 wherein the recirculation gate includes a generally contoured upstream end.

18. The turbocharger of claim 10 wherein the recirculation gate includes a downstream end that defines an inlet to the recirculation groove.

19. A turbocharger for an internal combustion engine, comprising:

a compressor having an impellor disposed in a compressor chamber for receiving fluid flow;

a flow regulation mechanism disposed in the compressor, comprising:

a diffuser cover moveably disposed in a diffuser passage from a first position permitting fluid flow through the diffuser passage to a second position at least partially impeding the fluid flow through the diffuser passage;

a recirculation gate moveably disposed in the compressor chamber from a first position closing a recirculation groove to a second position opening the recirculation groove to fluid communication with the compressor chamber;

wherein the diffuser cover and the recirculation gate are moved generally simultaneously from the respective first positions to the respective second to maintain constant manifold pressure independent of engine speed and load.

20. The turbocharger of claim 19 wherein the flow regulation mechanism is operated one of automatically and manually.

* * * * *